US006557315B2

(12) United States Patent
Tremblay

(10) Patent No.: US 6,557,315 B2
(45) Date of Patent: May 6, 2003

(54) METAL ROOFING SHINGLE

(75) Inventor: Pierre Tremblay, Canadian (CA)

(73) Assignee: Tecta Inc., Chicoutimi (CA)

( * ) Notice: Subject to any disclaimer, the term of this patent is extended or adjusted under 35 U.S.C. 154(b) by 135 days.

(21) Appl. No.: 09/766,755

(22) Filed: Jan. 22, 2001

(65) Prior Publication Data

US 2002/0095901 A1 Jul. 25, 2002

(30) Foreign Application Priority Data

Jan. 16, 2001 (CA) ..... 2331166

(51) Int. Cl.[7] ..... E04D 1/34
(52) U.S. Cl. ..... 52/552; 52/553; 52/520
(58) Field of Search ..... 52/543, 551, 552, 52/553, 94, 519, 520

(56) References Cited

U.S. PATENT DOCUMENTS

| | | | | | |
|---|---|---|---|---|---|
| 1,470,837 | A | * | 10/1923 | Hofstatter | 52/552 |
| 1,583,254 | A | * | 5/1926 | Lietz | 52/545 |
| 1,813,798 | A | * | 7/1931 | Gerosa | 52/548 |
| 3,973,369 | A | | 8/1976 | Smith | |
| 4,079,561 | A | | 3/1978 | Vallee | |
| 4,218,857 | A | * | 8/1980 | Vallee | 52/94 |
| 4,527,374 | A | | 7/1985 | Corbin | |
| 5,442,888 | A | | 8/1995 | Ilnyckyj | |
| 5,495,654 | A | | 3/1996 | Goodhart et al. | |
| 5,595,813 | A | | 1/1997 | Ogawa et al. | |
| 5,613,337 | A | | 3/1997 | Plath et al. | |
| 5,711,127 | A | * | 1/1998 | Sabourin | 52/530 |
| 5,946,877 | A | | 9/1999 | Gallinat et al. | |

FOREIGN PATENT DOCUMENTS

| | | |
|---|---|---|
| CA | 1042177 | 11/1978 |
| CA | 2198967 | 9/1998 |

* cited by examiner

*Primary Examiner*—Carl D. Friedman
*Assistant Examiner*—Naoko Slack
(74) *Attorney, Agent, or Firm*—Merchant & Gould P.C.

(57) ABSTRACT

A roofing shingle for mounting to a roof surface which comprises a flat rectangular panel made of metallic sheet material and has top and under sides and side edges. The top side displays along at least two of the side edges a series of dimples defining corresponding bosses on the under side which lie flush with the roof surface. A series of connecting elements have one end mounted to a corresponding boss and an opposite end projecting beyond the side edges for being connected to the roof surface. The shingle includes locating means on its top and under sides for positioning the shingle with a corresponding like shingle to define an overlapping region therebetween. A roof covering using these roofing shingles which are interconnected and staggered along the roof surface with their respective under sides substantially parallel to one another and in close contact at the overlapping region.

22 Claims, 6 Drawing Sheets

METAL ROOFING SHINGLE

FIELD OF THE INVENTION

The present invention relates to roofing shingles. More specifically, the present invention is concerned with a roof covering using metal roofing shingles and with a process for constructing such roof coverings.

BACKGROUND OF THE INVENTION

Roof coverings made from sheet material shingles are well known. The shingles are usually made from sheet metal, notably copper, terne-coated stainless steel or aluminium, and are used to provide a long lasting roof.

Constructing metallic shingle roof coverings having water shedding joints has been attempted through either shingle overlap or folded over and interlocking edges. Simple overlapping of light gauge sheet metal shingles allows the transport of water across the overlap to the under-roof because the overlapping surfaces are not, in practice, plane, parallel, and thus, in close contact over the whole overlap area. Furthermore, the lower part of the shingles would be easily lifted by even slight winds.

That is the reason why most commercial sheet metal shingles are based on the concept of folded over edges designed to interlock with each other. However, such shingles fail to provide complete weatherproof protection.

Furthermore, folded-edge shingles have to be made from light gauge sheet metal, typically 0.020 inches thick, in order to be folded over a suitably small radius. This has an important bearing on hail resistance (proportional to the 3rd power of material thickness) and wind uplift resistance (proportional to the resistance of a fold to unfolding, which in turn is proportional to the 3rd power of material thickness). Besides this, folded-edge shingles must be made in relatively small sizes because folding and interlocking of all four sides allows practically for only one fastener per shingle; thus adequate fastening per unit surface limits the shingle size. This greatly affects manufacturing and installation costs, which depend upon shingle size.

Folded-edge shingles have another drawback when the chosen metal is aluminium. The shingles cannot be made from anodised sheet metal which cannot be folded over a small enough radius when anodised at architectural thickness (18 $\mu$m and over) and post-folding anodisation is uneconomical because of the small size of the shingles. Thus, aluminium folded-over shingles are inevitably painted. This leads to the loss of the distinctive, metallic aspect and to other problems associated with volatile organic compound (VOC) emissions at the painting line, colour degradation of the roof because of organic pigment sensitivity to UV rays, and finally, obnoxious emissions when recycling either process scrap or shingles, especially if the paint contains fluorocarbons.

Prior art metallic shingles, being essentially of the folded edge design, have other shortcomings. As for aesthetics, they cannot feature rounded corners (which constitute an important element among those that can be used to design distinctive geometric roof patterns). Concerning fabrication costs, folded-edge shingles are made from blanks that have several notches and re-entrant angles, which require custom dies; the blanks must further be processed in specially designed folding machines. Special elements are needed for building the roof covering at eaves, gable edges, hips and valleys.

There is an ongoing demand for a roof covering made of metal roofing shingles, which can shed water, prevent ingress of wind-driven rain, be weather resistant, resist the assaults of wind, UV rays, snow, ice, extremes of temperature (typically from −40° C. to +100° C.) while being relatively inexpensive to manufacture, easy to construct and having aesthetic value in terms of colour, texture or geometry.

OBJECTS OF THE INVENTION

One object of the present invention is therefore to provide an improved metal roofing shingle used for building an improved roof covering.

Another object of the invention is to provide a metal roofing tile free of the above-noted disadvantages.

A further object of the invention is to provide a metal shingle having non-folded edges.

Yet, another object of the present invention is to provide a shingle that is resistant to the action of UV rays, wind, hail, temperature extremes while remaining easy and relatively inexpensive to manufacture.

Yet, a further object of the present invention is to provide a roof covering that is waterproof and has an exceptionally long life.

SUMMARY OF THE INVENTION

More specifically, in accordance with the present invention, there is provided a roofing shingle for mounting to a roof surface which comprises:

a substantially flat and generally rectangular shaped panel made of metallic sheet material, the panel having a top side and an under side and defining side edges, the top side displaying along at least two of the side edges a series of dimples defining corresponding bosses on the under side;

a series of connecting elements having one end mounted to a corresponding boss and an opposite end projecting beyond the side edges, the connecting elements allowing connection with the roof surface; and locating means on the top and under sides for positioning the shingle with a corresponding similarly constructed shingle to define an overlapping region therebetween.

Preferably, this one end of each connecting element is pivotally mounted to the corresponding boss.

Preferably, each connecting element consists of a tab member and the other end of the connecting element displays an aperture for receiving a fastening element for connection to the roof surface.

Advantageously, when the shingle is positioned with a corresponding similarly constructed shingle, the respective under sides of the positioned shingles are substantially parallel to one another in the overlapping region.

Preferably, the locating means consist of complementary top side and under side locating elements. More preferably, one of the top side and under side locating elements is mounted near side edges devoid of connecting elements and the other of the top side and under side locating elements is mounted near side edges including connecting elements.

Preferably, the under side locating element consists of a tab member having offset first and second body portions, the first body portion being mounted to the under side and the second body portion forming a gap with the under side.

Preferably, the top side locating element consists of at least one dimple formed on the top side and a flat band partially covering the dimple, the second body portion of the tab member of a corresponding similarly constructed shingle being received in this one dimple and contacting the flat band, the flat band having a thickness equal to or less than the gap between the second body portion and the under side, and this one dimple having a depth equal to or less than the depth of the corresponding boss of each of the series of dimples.

Advantageously, the flat band has a thickness equal to or less than the thickness of the shingle.

Preferably, the second body portion of the tab member defines a resilient stopper upwardly extending therefrom and abutting the under side, the flat band defines a free edge abutting the resilient stopper of a corresponding similarly constructed shingle, and the resilient stopper is deformable so as to substantially clear the gap between the second body portion of the tab member and the under side.

Advantageously, the shingle is made of metallic material selected from the group consisting of stainless steel, terne-coated stainless steel, zinc, copper, clear-anodised aluminium and colour-anodised aluminium.

In accordance with another aspect of the present invention, there is provided a roof covering for mounting to a roof surface defining a peripheral edge, the roof covering comprising:

interconnected shingles, each shingle comprising a substantially flat and generally rectangular shaped panel made of metallic sheet material, the panel having a top side and an under side and defining side edges, the top side displaying along at least two of the side edges a series of dimples defining corresponding bosses on the underside, a series of connecting elements having one end mounted to a corresponding boss and an opposite end projecting beyond the side edges, the connecting elements allowing connection with the roof surface, and locating means on the top and under sides for positioning the shingle with a corresponding similarly constructed shingle to define an overlapping region therebetween.

Preferably, each connecting element consists of a tab member, the one end of the connecting element being pivotally riveted to the corresponding boss and the other end of the connecting element displaying an aperture for receiving a fastening element for connection to the roof surface.

Preferably, the interconnected shingles are staggered along the roof in regular arrays with their respective under sides substantially parallel to one another in the overlapping region.

Preferably, the regular arrays consist of at least four rows of overlapping shingles, the over sides and under sides of overlapping shingles are maintained in close contact in the overlapping region for any particular shingle in a given row by the interconnection of that particular shingle with a shingle in a second lower row to that given row and by the interconnection of a shingle of a first upper row to that given row with a shingle in a first lower row to that given row, and with the shingles of these first upper and first lower rows being adjacent to that particular shingle.

Preferably, the roof covering defines an outwardly projecting peripheral edge and the bosses provide a space between the under side and the outwardly projecting edge and the roof covering further comprises plates for being fitted in this space and for being connected to both the shingles and the roof and an open moulding mounted to the outwardly projecting roof peripheral edge providing ventilation of the roof covering.

Alternatively, the roof surface further includes two adjacent planes having respective inward ends that meet to form an intersection with an inward angle defining an apex line, the shingles of both planes being cut at the intersection along a line parallel to the apex line, the bosses providing a space between the under sides of the shingles and the roof surface with the plates being fitted in this space, the plates being connected to both the shingles and the roof surface.

Alternatively, the roof surface further includes two adjacent surface planes having respective uppermost ends that meet to form an outward angle, the shingles at the uppermost ends of each of the planes have respective upwardly bent portions about the outward angle, the upwardly bent portions being adjacent and substantially parallel to one another, the roof covering further comprising tube members being fastened between the adjacent bent portions, and a cap moulding capping the upwardly bent portions.

In accordance with yet another aspect of the present invention, there is provided a process for covering a roof surface using the roofing shingle of the present invention, the roof surface having a peripheral roof projecting edge overhanging a wall structure, the process comprising the steps of:

(a) mounting an elastomer membrane on the roof surface;

(b) mounting generally rectangular plates of a metallic sheet material on the projecting edge over the elastomer, the plates having a bottom edge projecting beyond the roof projecting edge;

(c) mounting a moulding made of metallic sheet material to the roof projecting edge, the moulding having a substantially flat wide portion with an upwardly curved recessed end, the wide portion is placed under the roof projecting edge and the recessed end receives the plate bottom edge therein;

(d) cutting the shingles to produce shingle-portions and mounting the shingle-portions unto the elastomer membrane and the plates with the cut edge of a the shingle-portions being fitted within the upwardly curved recess;

(e) positioning the shingles, starting with the shingle-portions, to corresponding shingles, by interconnecting the corresponding locating means, along the roof surface in a staggered manner such that the respective under sides of the positioned shingles are substantially parallel to one another in the overlapping region; and (f) connecting the shingle connecting elements to the roof surface.

Alternatively, the roof surface further includes two adjacent surface planes having respective inward ends that meet to form an intersection with an inward angle defining an apex line, the process further comprising the steps of:

(a) mounting a metallic flashing along the intersection of the planes, extending on both sides of the apex line over such a distance sufficient for preventing rainwater from reaching the roof surface;

(b) mounting the generally rectangular plates over the metallic flashing on both sides of the apex line, the plates having a longitudinal axis and having two long sides and two short sides, the longitudinal axis is perpendicular to the apex line and the short side being closest to the apex line does not abut the apex line;

(c) mounting the moulding to the metallic flashing, the wide portion is placed under the plates and the recessed end receives the short edge closest to the apex line of the plates mounted over the flashing;

(d) cutting the shingles along a line determined by the moulding recessed end, mounting the cut shingles unto the plates with their cut edge being fitted within the upwardly curved recess of the moulding.

Alternatively, the roof surface further includes two adjacent surface planes having respective uppermost ends that meet to form an outward angle, the process further comprising the steps of:

(a) upwardly bending the shingles at the uppermost ends, such that the uppermost end shingles of the two surface planes form two substantially parallel adjacent bent portions about the outward angle;

(b) placing a tube member between the adjacent bent portions, the tube member being snugly fitted therebetween and having opposite sides, each opposite sides being connected to a respective bent portion to from a tube-shingle assembly; and (c) capping the tube-shingle assembly with a cap moulding.

In accordance with still yet another aspect of the present invention, there is provided a metal roofing shingle for mounting to a roof surface, the shingle having a substantially flat and generally rectangular configuration and comprising:

spacing means for upwardly spacing the shingle from the roof surface;

connecting means for mounting the shingle to the roof surface, the connecting means having means so as to be adaptable to thermal expansion and contraction of the shingle; and locating means for positioning the shingle with a corresponding similarly constructed shingle, the locating means having means so as to be adaptable to thermal expansion and contraction of the shingle.

Other objects, advantages and features of the present invention will become more apparent upon reading of the following non restrictive description of preferred embodiments thereof, given by way of example only, with reference to the accompanying drawings.

BRIEF DESCRIPTION OF THE DRAWINGS

In the appended drawings, like reference numbers indicate like elements throughout.

DESCRIPTION OF THE PREFERRED EMBODIMENT

Figure 2:
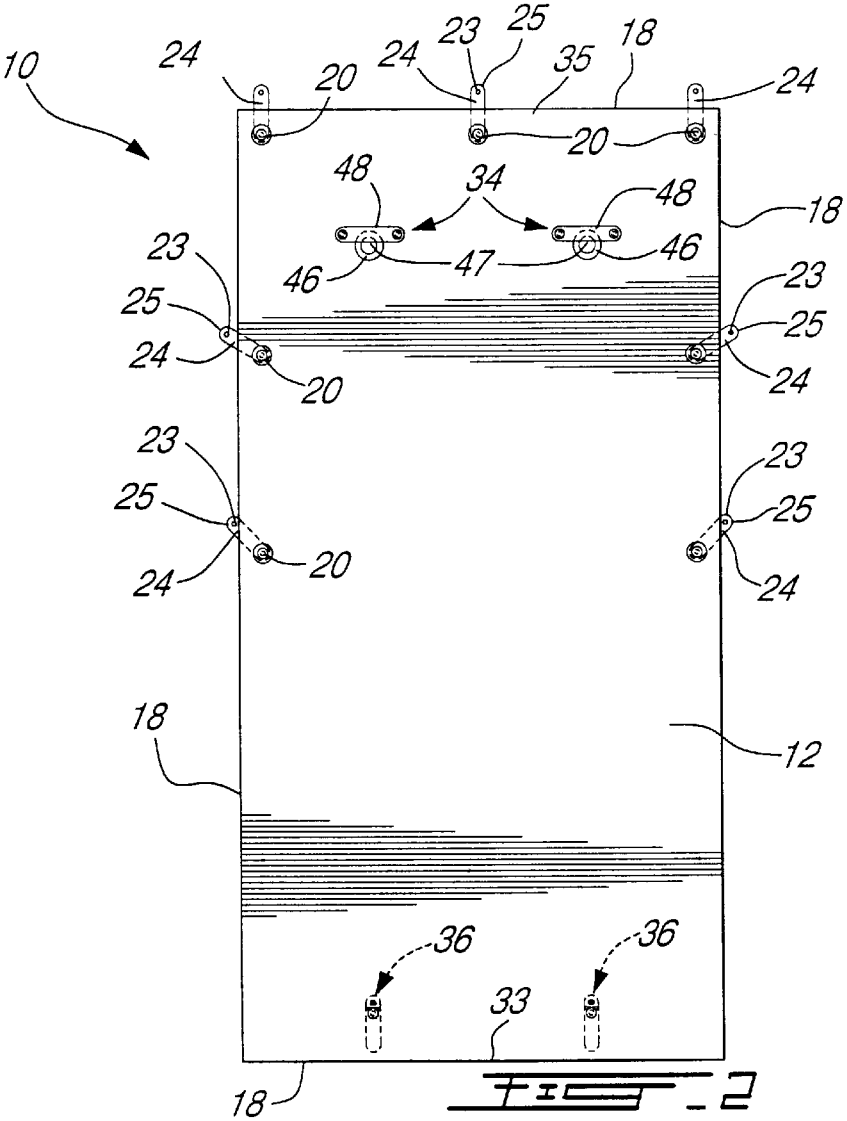
FIG. 2 is a top plan view of a second embodiment of the roofing shingle according to the present invention having a rectangle-shape configuration.
Figure 1:
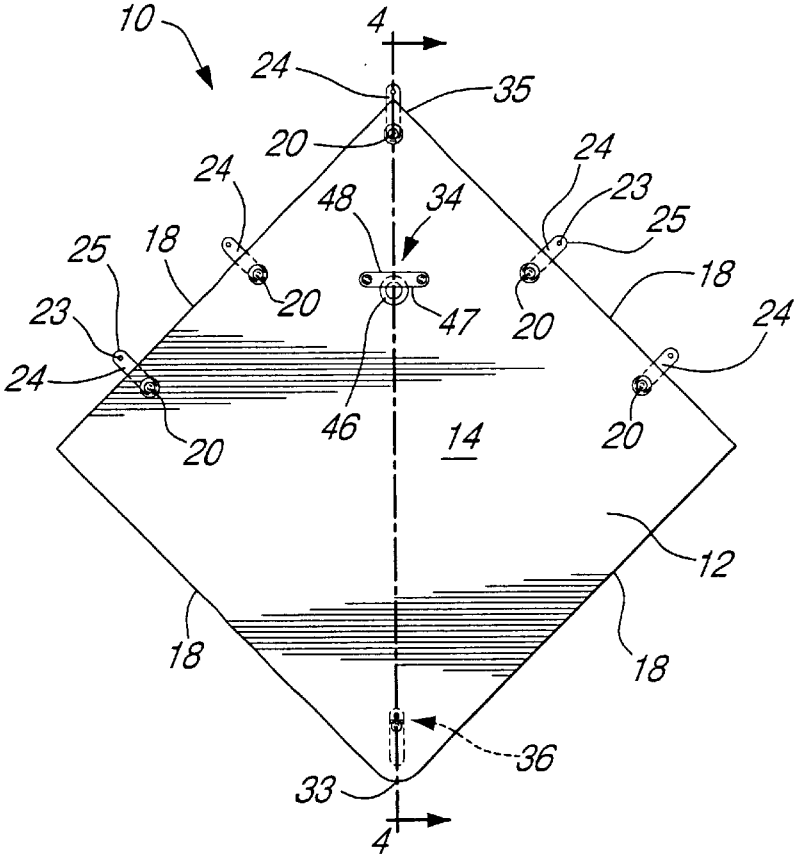
FIG. 1 is a top plan view of one embodiment of the roofing shingle according to the present invention having a square-shape configuration.

FIGS. 1 and 2 show two preferred configurations of the present roofing shingle 10 which is used for mounting to a roof surface. Shingle 10 is made of a substantially flat panel 12 having a generally rectangular configuration, such as a square shape as in FIG. 1, for roof coverings having a diamond pattern, or a rectangle shape as in FIG. 2, for roof coverings having classic patterns of parallels and perpendiculars to the roof eaves, or any other like suitable shape.

Panel 12 has a top side 14 which is exposed and an under side 16 (see FIG. 4) which faces the roof surface. The panel 12 is bounded by non folded side edges 18 and is made of metallic sheet material, preferably of a relatively heavy gauge sheet (typically 0.050 inches and over).

More preferably, the panel 12 is made of stainless steel, terne-coated stainless steel, zinc, copper or anodised aluminium which may be clear-anodised or colour-anodised through a process based on light interference; the foregoing materials provide the shingle 10 with resistance to weather conditions such as the actions of UV rays, wind, hail and extremes of temperature and with an exceptionally long life. The substantially flat panel 12 is also easy to fabricate, install and recycle when made of these materials and particularly so when the material is aluminium.

The top side 14 of shingle 10 displays dimples 20 along the side edges 18 of about half of the shingle periphery. Advantageously, the dimples 20 are displayed along the edges 18 of the "upper" half of the shingle periphery.

Figure 4:
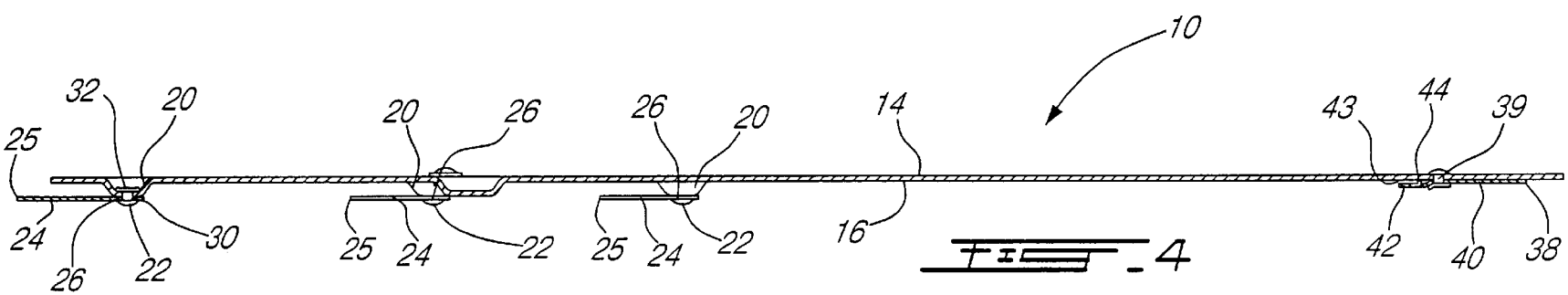
FIG. 4 is a sectional view of FIG. 1 along line 4—4.

The dimples 20 are concave with respect to the top side 14 and, as shown in FIG. 4, define respective corresponding bosses 22 on the under side 16. Bosses 22 lie flush with the roof surface and hence, upwardly space the under side 16 from the roof surface creating a gap of several millimeters therebetween. This gap substantially decreases heat conduction between the shingle 10 and the roof surface.

A series of connecting elements for connecting the shingle 10 to the roof surface, preferably in the form of tab members 24, are mounted to corresponding bosses 22 as better shown in FIG. 4. Preferably, tab members 24 are made of the same metal as the panel 12 in order to avoid galvanic corrosion, which may take place when dissimilar metals are in electrical contact. Tab members 24 may be in the form of an oblong rectangle with rounded ends. It is within the scope of the invention that other suitable types of connecting elements may also be used.

A tab member 24 has one end 26 (see FIG. 4) mounted to a corresponding boss 22 and an opposite free end 25 (see FIGS. 1, 2 and 4) projecting beyond a corresponding side edge 18 so as to be connected to the roof surface.

A tab member end 26 may be pivotally mounted to a corresponding boss 22 and thus may include an aperture (not shown) for receiving a semi-tubular rivet 32 so as to be riveted to a boss 22, via a boss central hole 30, with the rivet 32 being set inside the dimple 20. The depth of a dimple 20 provides a countersunk area in which the shank of the semi-tubular rivets 32 are set flush with top side 14. The pivotability of the tab member end 26 with respect to a boss 22 can provide the tab member 24 with the ability to adapt to the thermal expansion and contraction of the shingle 10 between temperature extremes. The foregoing is best achieved when a shingle 10 is installed on a roof surface with the tab members 24 oriented as shown in FIGS. 1 and 2.

The shingle 10 may be attached to the roof surface with fastening elements such as screws (not shown) or the like driven through apertures 23 at the free ends 25 of tab members 24. In this way, the head height of the screws used to attach the shingle 10 to a roof surface can be almost as high as the boss 22 depth and thus large screws may be used. The attachment screws are also protected from weather exposure and the periphery of the screw hole in the roof membrane is sealed by the tab member 24.

The shingle 10 further includes locating means, for interconnecting a shingle 10 to a corresponding similarly constructed shingle 10, which can be in the form of a variety of complementary locating elements such as top side locating element 34 and under side locating element 36 mounted on the top and under sides 14 and 16 respectively. Preferably, the top side and under side locating elements 34 and 36 are respectively mounted near opposite side edges 18. The foregoing will provide for similarly constructed shingles 10 to be interconnected so as to define an overlapping region 15 (see FIG. 5) therebetween, where an under side locating element 36 of one shingle 10 is interconnected to a top side locating element 34 of another similarly constructed shingle 10.

Figure 5:
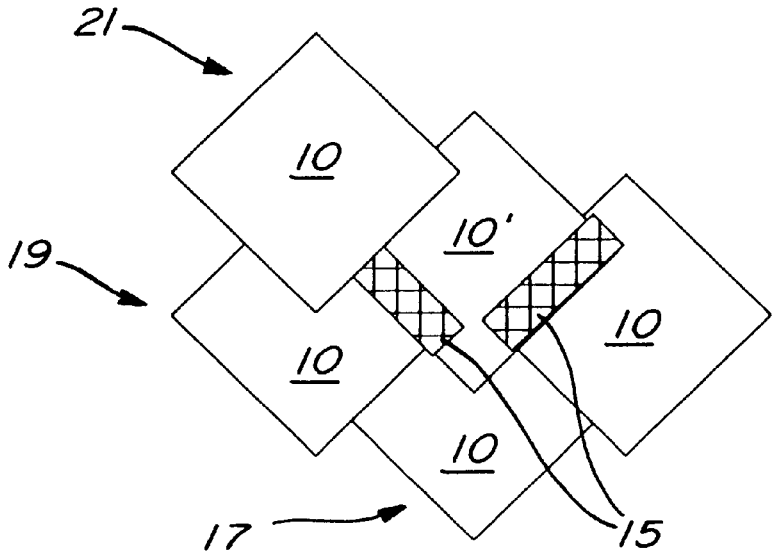
FIG. 5 is a schematic view of like shingles being interconnected in accordance with the present invention.

In this way and with particular reference to FIG. 5, the interconnected similarly constructed shingles 10 may be positioned on a roof surface to form regular arrays of at least four rows. Close contact is maintained in the overlapping regions 15 between the under sides 14 and the over sides 16 of corresponding shingles 10 through the combined action, for any particular shingle of a given row such as shingle 10', of its own interconnection with a shingle 10 in the second lower row 17, and the interconnection of an adjacent shingle 10 in the first upper row 21 with a shingle 10 in the first lower row 19 that is adjacent to that particular shingle 10'. Hence, shingle 10' is sandwiched, on both sides, between an adjacent shingle 10 of the first lower row 19 and an adjacent shingle 10 of the first upper row 21 to keep the under side 14 of this particular shingle 10' in close contact with the over side 16 of the shingle 10 of the first lower row 19 in the overlapping regions 15. This close contact prevents ingress of wind-driven rain between two interconnected shingles, making roof coverings made of shingles 10 interconnected in the foregoing manner substantially waterproof.

Depending on the configuration of shingle 10 one or more top side and under side locating elements 34 and 36 may be provided. For example, the square-shaped shingle 10 of FIG. 1 includes one top side and one under side locating elements 34 and 36 while the rectangle-shaped shingle 10 of FIG. 2 includes two top side and two under side locating elements 34 and 36. Of course, a greater number of top side and under side locating elements 34 and 36 may also be contemplated.

Figure 3A:
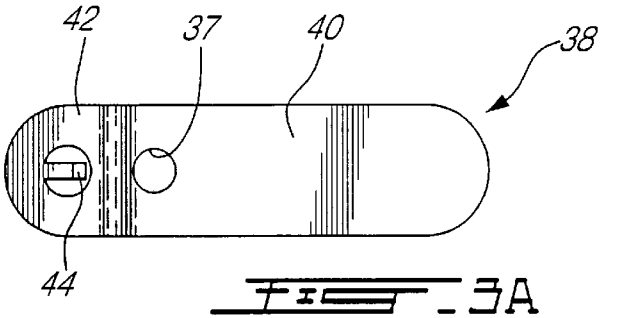
FIG. 3*a* is a top plan view of a top side locating element of the roofing shingle.
Figure 3B:
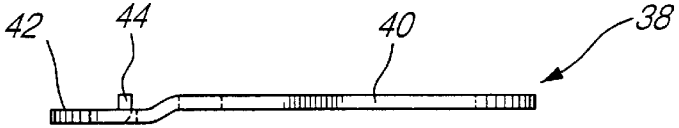
FIG. 3*b* is a side elevation view of the top side locating element of FIG. 3*a;*

In the preferred embodiment illustrated herein, the under side locating element 36 is mounted on the under side 16 near the "bottom" end 33 of shingle 10 and may include a tab member 38 having a rectangular oblong shape as better shown in FIGS. 3A and 3B. The tab member 38 defines first and second offset and preferably parallel body portions 40 and 42, respectively. The first body portion 40 is fastened to the under side 16 by driving a rivet 39 though both its aperture 37 and shingle 10 (see FIGS. 3A and 4), while the second body portion 42 forms a gap 43 (see FIG. 4) with the underside 16 of about one shingle 10 thickness.

The second body portion 42 may also include a resilient stopper, in the form of a flexible tongue 44 for example, upwardly extending therefrom and abutting the under side 16. The flexible tongue 44 may be obtained by an appropriate cut-out of the first body portion 42, the tip of which is upturned preferably, over about $1/16^{th}$ of an inch and over somewhat less than 90°, thus creating a stopper which is resilient so as to be deflected when subjected to large forces, substantially clearing the gap 43 between the second body portion 42 and the under side 14. When deflected away, the tongue stopper 44 opens the gap 43 for the contraction of the shingle 10 over the maximum temperature range. Therefore, the resilient stopper 44 provides for the locating element 36 to be adaptable to variations in size of the shingle caused by extreme changes in temperature.

The top side locating element 34 includes at least one dimple 46 formed on the top side 14, preferably of several millimeters in diameter, near the "top" 35 of the shingle 10. The dimple 46 has a depth that is equal or lesser than the depth of a given boss 22 and is partially covered by a substantially flat band 48. Advantageously, the flat band 48 is made from a strip of the same metallic material as the shingle 10 and may be riveted to the top side 14 with the rivets set in such a way that their heads are flush with the upper surface of the flat band 48. The width of the flat band 48 is preferably about equal to the dimple 46 radius and its free edge 47 is preferably along the horizontal diameter of the dimple 46.

When positioning two similarly constructed shingles 10, dimple 46 of one shingle 10 receives the second body portion 42 of the tab member 38 of another shingle 10. The second body portion is slid beneath the flat band 48 and pushed to a distance determined by the free edge 47 of the flat band 48 abutting the resilient stopper 44.

The different depths of bosses 22 of a same shingle 10 provides for the under side 16 to form a small angle with the roof surface. In this way, when constructing a roof covering in accordance with the present invention, a shingle 10 will rest evenly on all the bosses 22 of its under side 16, while it similarly rests evenly on the over sides 14 surfaces of the shingles 10 which it overlaps.

Figure 6:
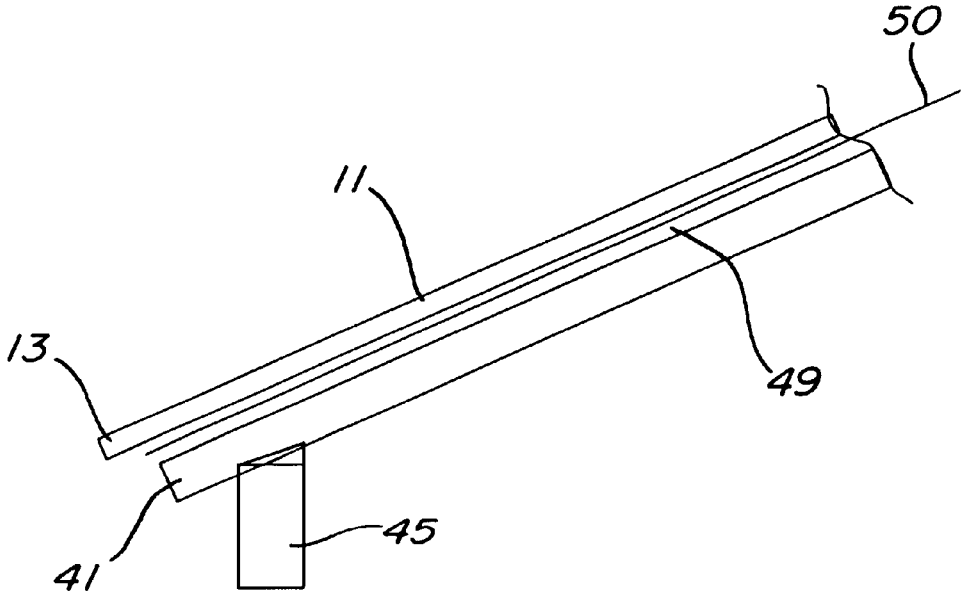
FIG. 6 is a schematic lateral view of the roof covering according to the present invention mounted to a roof surface.

Referring to FIGS. 5 and 6, the construction of a roof covering 11 with shingles 10, for diamond-pattern roof coverings (as shown in FIG. 5), rectangular-pattern coverings or other similar pattern coverings, starts with the installation of an elastomer membrane 50, preferably self-adhesive, over a continuous roof surface 49 such as a deck, typically made of plywood. Such roof surfaces 49 usually include a peripheral projecting edge 41, such as eaves and gable edges, that overhang a wall structure 45, correspondingly the roof covering 11 will also include an outwardly projecting peripheral edge 13.

Figures 7, 8, 9:
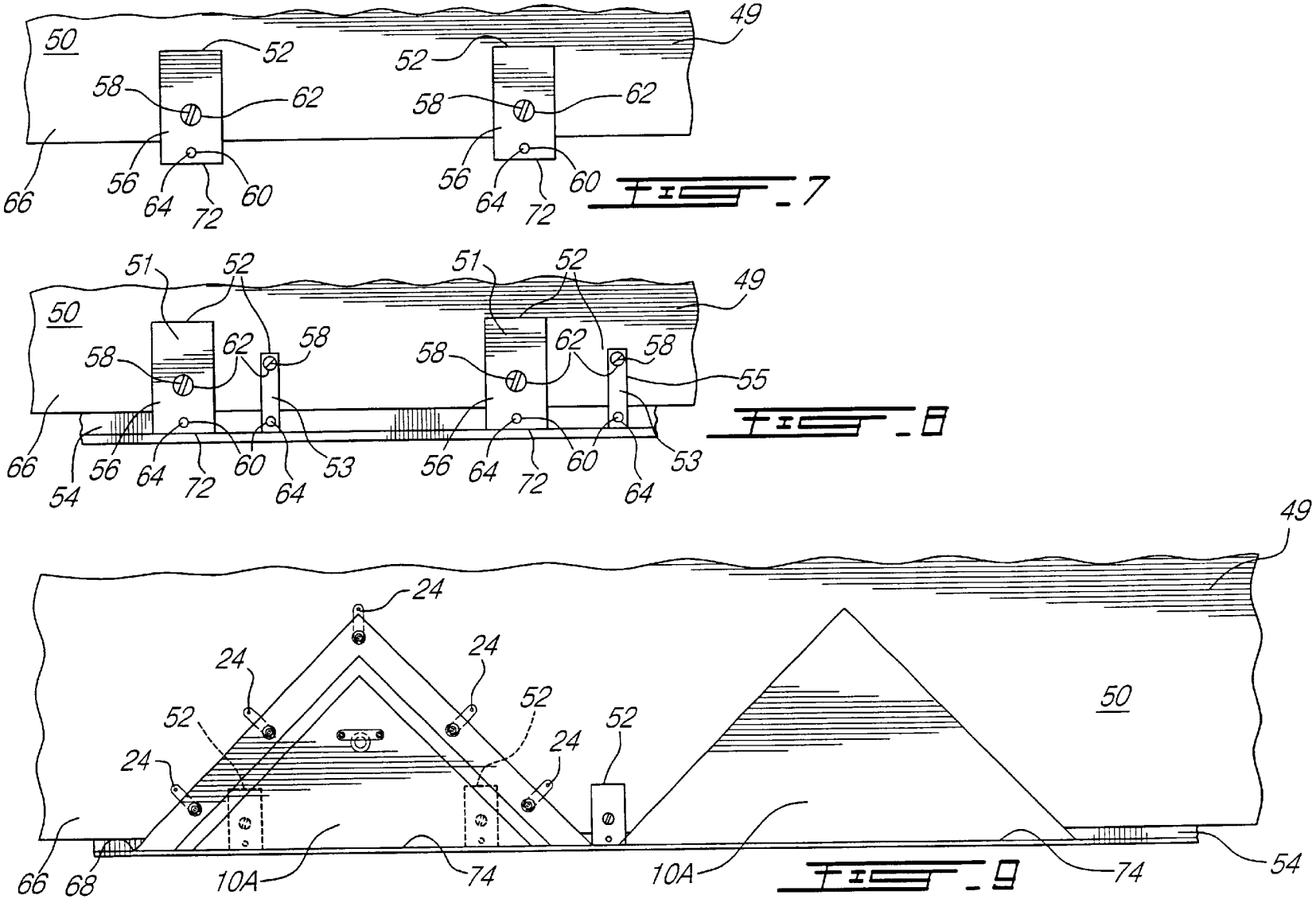
FIG. 7 is a top plan view of roof covering plates at roof edges or eaves according to the present invention.
FIG. 8 is a top plan view of the roof covering moulding installed at roof edges or eaves according to the present invention.
FIG. 9 is a top plan view of a starter course of the roof covering of the present invention.

The starter course of the roof covering is built with plates 52, a moulding 54, and shingles-portions 10A as shown in FIGS. 7, 8 and 9.

The plates 52 are of a generally rectangular configuration and have a top surface 56 and an under surface (not shown). Preferably, plates 52 are made of the same metallic sheet material as the shingles 10. Advantageously, two different sized plates are used; a larger sized plate 51, preferably of about 25 cm×5 cm×3 mm, and a smaller sized plate 53, preferably of about 10 cm×5 cm×3 mm. The plates 52 have lower and upper holes 60 and 62, respectively.

Holes 60 and 62 are deeply countersunk respectively on the top surface and the under side of the plates 52. The countersink of the upper hole 62 receives a flat-head wood screw 58, preferably of the same metal as the plate 52, which is set flush with the top surface 56. The countersink of the lower hole 60 will contain the deformed part of a semi-tubular or blind rivet 64, again preferably of the same metal as the plate 52, which is dimensioned so as to be set flush with the top surface 56 of the plates 52.

The plates 52 are installed at roof eaves 66 over the elastomer membrane 50, using screws 58 driven through the upper hole 62 near the centre of larger plate 51 and near the top of smaller plate 53. The plates 52 have a lower edge 72 that extends beyond the eaves 66.

The roof covering 11 according to the present invention also includes mouldings 54, again preferably of the same metal as the shingle 10, the section of which is J-shaped defining a recess 68 and a wider side 70. The wider side 70 is open-work and fitted with regularly spaced mounting tabs (not shown) of the same metal, several millimeters in length (preferably, 50 mm when used at eaves, 250 mm when used at valleys) riveted perpendicularly to the moulding 54 at one end and screwed to the roof surface 49 at the other end.

The moulding 54 is installed by inserting the lower tips 72 (see FIG. 9) of the plates 52 in the moulding recess 68 and screwing the free end 25 of the tab 24 to the roof surface 49. The moulding 54, which is typically several meters long, can freely expand and contract while being solidly fixed to the roof surface 49. The open moulding 54 provides for the ventilation of the roof covering 11.

To complete the starter course of the roof covering 11, shingle-portions 10A are installed. Holes are punched along the shingle-portions lower edge 74 concentric with the lower end holes 60 of the plates 52 which they cover (shown in dotted line in FIG. 9). Concentricity is easily achieved because the holes are always punched in the shingles at the same distance from their lower edge 74 and the exact position of the plate holes 60 along the eave can be reported on the moulding and marked off the shingles. Furthermore, if necessary to achieve perfect concentricity, plates 52 can be slightly rotated to the left or right. The shingle-portions 10A are installed with the lower horizontal edge 74 being inserted in the moulding recess 68, thus masking any imperfection of the cut. Hence, the moulding recess end 68 defines the outwardly projecting peripheral edge 13 of the roof covering 11.

The dimples of the shingle-portion 10A determine a gap of about 5 mm between the roof surface and the under side 16 of the shingle-portion 10A so that the shingle-portion 10A rests evenly on bosses 22 and the top surface 56 of the plates 52.

Semi-tubular rivets or blind rivets (not shown) are then set, fixing the shingle-portions 10A to plates 52. The plate 52 thickness allows the rivets to be set flush with the under side (not shown) of the plate 52. In this way, the starter course of the roof covering is extremely resistant to the actions of wind, ice and temperature extremes.

Construction of the roof covering 11 at gable edges is similar to that described above for roof eaves.

The plates 52 and mouldings 54 are installed, as the construction of the roof covering proceeds upwards, or are pre-installed. Shingles 10 are cut on the site, either by scoring the shingle 10 along the cut with a utility knife, bending and breaking, or using a special cutter. When the cutting line passes through a dimple 20, the latter may be simply hammered flat after removing the connecting tab 24.

Corresponding similarly constructed shingles 10 are interconnected as described above and staggered along the roof surface. Each shingle 10 is fastened to the roof surface 49 by driving screws though the free end 25 apertures 23 of tab members 24, preferably using screws of the same metal as the shingle 10.

Figure 10:
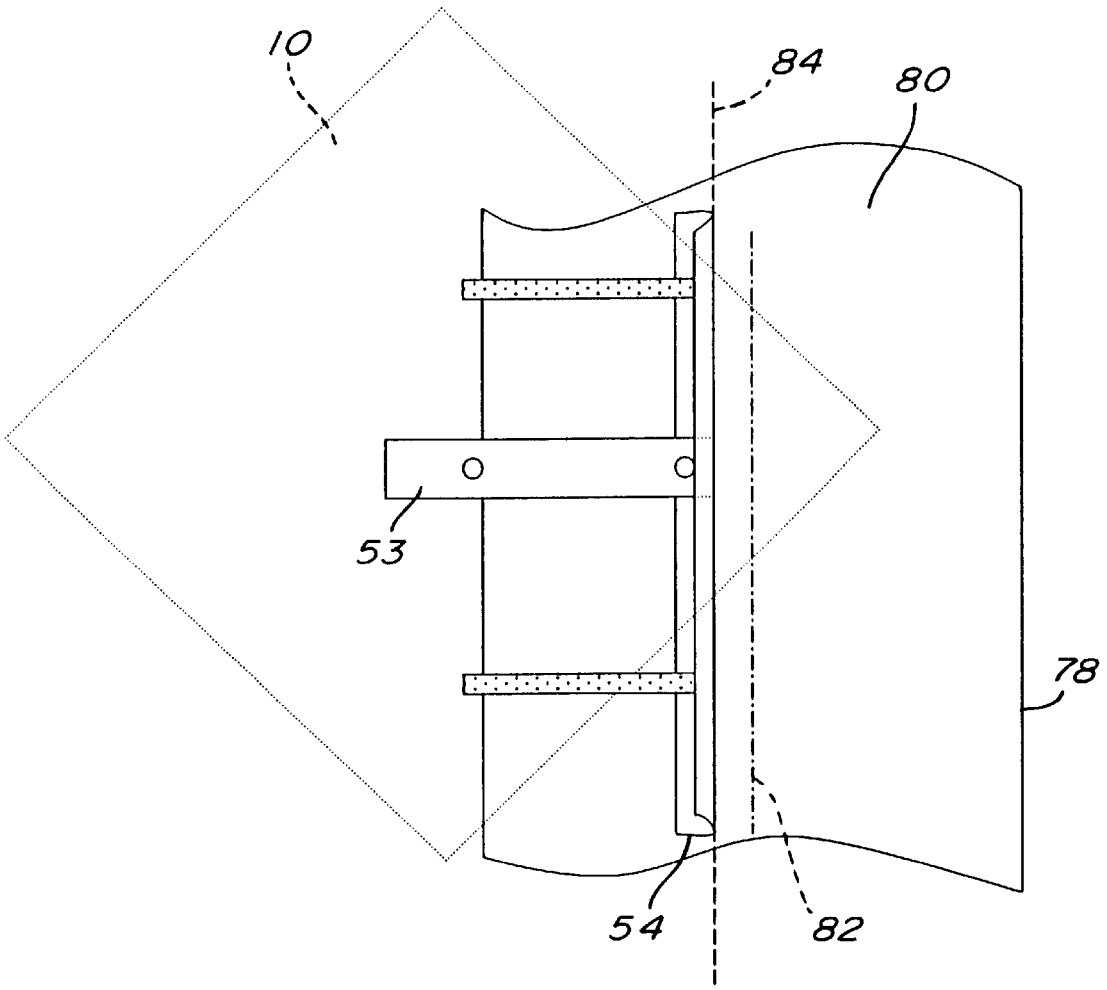
FIG. 10 is a schematic top plan view of the roof covering flashing and moulding installed at a roof valley according to the present invention.

At valleys, as shown in FIG. 10, where two roof planes having respective inward ends that meet to form an intersection at some inward or re-entrant angle defining an apex line or valley centre line 82 therebetween, the shingles 10 of both planes (here only one shingle is shown in dotted line) are cut and installed over metallic flashing 78 of the same metal as to form an open valley 80. The flashing 78 extends on either side of the valley centre line 82 over such a distance as required for preventing rainwater from reaching the roof surface 50 or as may be prescribed by regulations. The roof covering edges 13, on either side of the apex line 82, are indirectly attached to the roof surface 49 in a similar manner to that used for attaching the edges 41 at eaves and gable ends.

The smaller plates 53 are mounted over the flashing 78 on both sides of the apex line 82. The long axis of plate 53 is perpendicular to the apex line 82 and the short edge of the plate 53 closest to the centre line is at some distance from the apex line 82, typically one inch.

The moulding 54 is mounted with its wide portion 70 being placed under plates 53 and the recessed end 68 receiving the short edge closest to the centre line of all the plates 53.

The shingles 10 that intersect the valley 80 along the line 84 determined by the moulding recessed end are cut and mounted unto plates 53 with the cut edge of a partial shingle being fitted within the upwardly curved recess 68 of the moulding 54. The edges of the shingles along the cutting line 84 are attached to the plate 53 using blind rivets as described for constructing the roof covering 11 at eaves. The roof covering 11 is thus void of any nail or screw hole within an adequate area on either side of the valley line 82, without any compromise concerning wind resistance. It is to be understood that this adequacy is with respect to regulations or standard practice.

Figure 11:
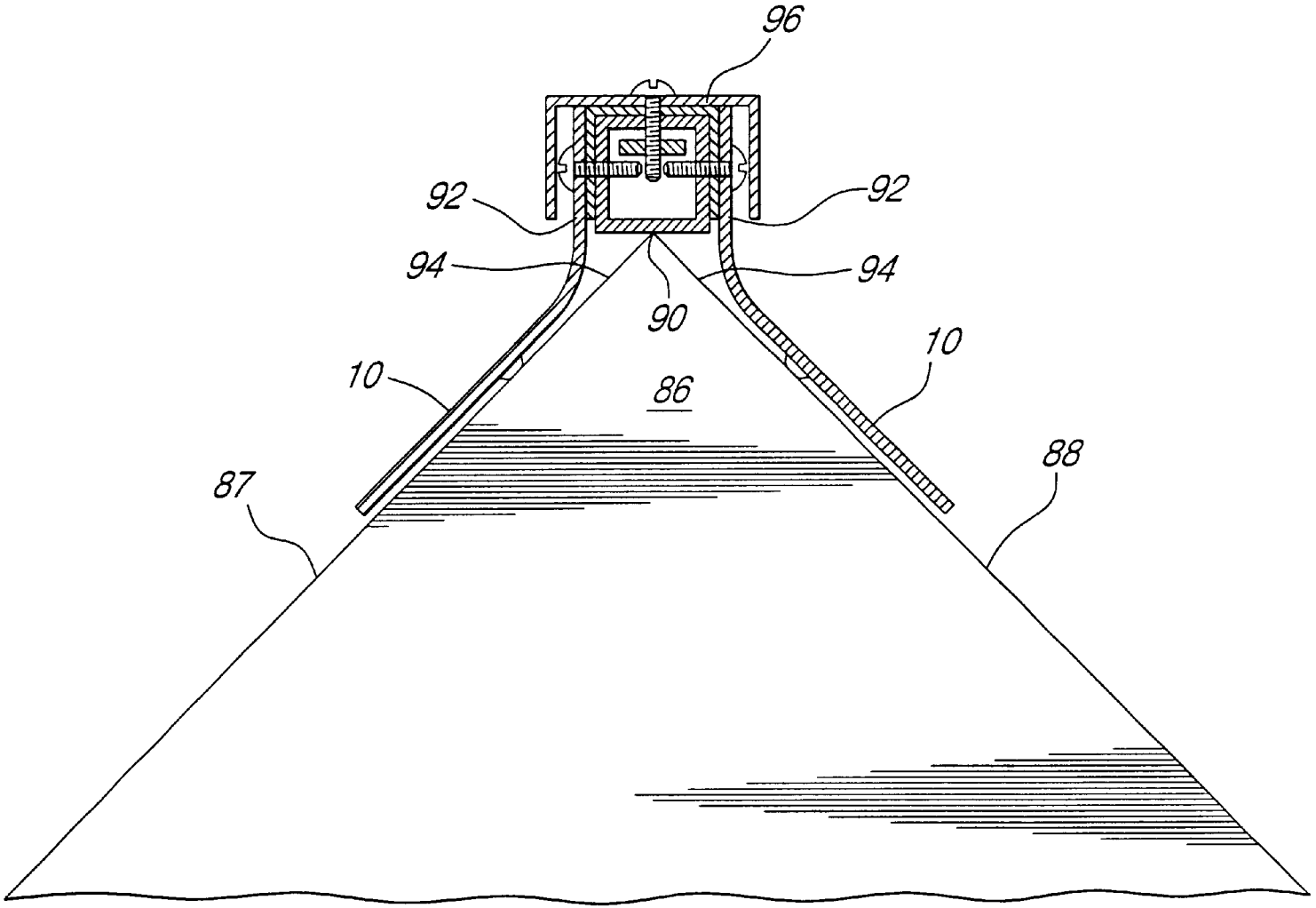
FIG. 11 is a top plan view of the roof covering at hips and ridges according to the present invention.

At hips and ridges 86, as shown in FIG. 11, where two planes 87, 88 of a roof surface 49 meet at some outward angle 90, shingle 10 edges 92 are upwardly bent. Thus, along the hip or ridge line 94, the up-turned shingle 10 edges 92 of the two planes 87, 88 are brought parallel and close to each other and screwed or riveted to discontinuous, short pieces of tube 86, preferably of the same metal as the shingle 10, preferably of square section, inserted between them.

A generally U-shaped moulding 96 caps the shingle-tube assembly. To allow for thermal expansion and contraction, the U-shaped moulding 88 is screwed at regular intervals to flat pieces of metal, inserted in two adjacent metal tube sections and bridging the space between them.

In this way, the shingle 10 is used to build a waterproof roof covering 11 having an exceptionally long life.

It is to be understood that the invention is not limited in its application to the details of construction and parts illustrated in the accompanying drawings and described hereinabove. The invention is capable of other embodiments and of being practised in various ways. It is also to be understood that the phraseology or terminology used herein is for the purpose of description and not limitation. Hence, although the present invention has been described hereinabove by way of preferred embodiments thereof, it can be modified, without departing from the spirit, scope and nature of the subject invention as defined in the appended claims.

What is claimed is:

1. A roofing shingle for mounting to a roof surface comprising:

a substantially flat and generally rectangular shaped panel made of metallic sheet material, said panel having a top side and an under side and defining side edges, said top side displaying along at least two of said side edges a series of dimples defining corresponding bosses on said under side;

a series of connecting elements having one end mounted to a corresponding boss and an opposite end projecting beyond said side edges, said connecting elements allowing connection with said roof surface; and locating means on said top and under sides for positioning said shingle with a corresponding similarly constructed shingle to define an overlapping region therebetween.

2. A roofing shingle according to claim 1 wherein said one end of each connecting element is pivotally mounted to said corresponding boss.

3. A roofing shingle according to claim 2 wherein each said connecting element consists of a tab member and wherein said other end of said connecting element displays an aperture for receiving a fastening element for connection to said roof surface.

4. A roofing shingle according to claim 1 wherein, when said shingle is positioned with a corresponding similarly constructed shingle, the respective under sides of said positioned shingles are substantially parallel to one another in said overlapping region.

5. A roofing shingle according to claim 1 wherein said locating means consist of complementary top side and under side locating elements.

6. A roofing shingle according to claim 5 wherein one of said top side and under side locating elements is mounted near side edges devoid of connecting elements and the other of said top side and under side locating elements is mounted near side edges including connecting elements.

7. A roofing shingle according to claim 5 wherein an under side locating element consists of a tab member having offset first and second body portions, said first body portion being mounted to said under side and said second body portion forming a gap with said under side.

8. A roofing shingle according to claim 7 wherein said top side locating element consists of at least one dimple formed on said top side and a flat band partially covering said dimple, said second body portion of the tab member of a corresponding similarly constructed shingle being received in said one dimple and contacting said flat band, said flat band having a thickness equal to or less than said gap between the second body portion and the under side, and said one dimple having a depth equal to or less than the depth of the corresponding boss of each of said series of dimples.

9. A roofing shingle according to claim 8 wherein said flat band has a thickness equal to or less than the thickness of said shingle.

10. A roofing shingle according to claim 8 wherein said second body portion of the tab member defines a resilient stopper upwardly extending therefrom and abutting said under side, said flat band defining a free edge abutting said resilient stopper of a corresponding similarly constructed shingle, and said resilient stopper being deformable so as to substantially clear said gap between said second body portion of the tab member and said under side.

11. A shingle according to claim 1 wherein said shingle is made metallic material selected from the group consisting of stainless steel, terne-coated stainless steel, zinc, copper, clear-anodised aluminium and colour-anodised aluminium.

12. A process for covering a roof surface using the roofing shingle of claim 1, said roof surface having a peripheral roof projecting edge overhanging a wall structure, said process comprising the steps of:

(a) mounting an elastomer membrane on the roof surface;

(b) mounting generally rectangular plates of a metallic sheet material on said projecting edge over said elastomer, said plates having a bottom edge projecting beyond said roof projecting edge;

(c) mounting a moulding made of metallic sheet material to said roof projecting edge, said moulding having a substantially flat wide portion with an upwardly curved recessed end wherein said wide portion is placed under said roof projecting edge and said recessed end receives said plate bottom edge therein;

(d) cutting said shingles to produce shingle-portions and mounting said shingles-portions unto said elastomer membrane and said plates with the cut edge of a said shingle-portions being fitted within said upwardly curved recess;

(e) positioning said shingles, starting with said shingle-portions, to corresponding shingles, by interconnecting said corresponding locating means, along said roof surface in a staggered manner such that said respective under sides of said positioned shingles are substantially parallel to one another in said overlapping region; and (f) connecting said shingle connecting elements to said roof surface.

13. A process for covering a roof surface according to claim 12, wherein said roof surface further includes two adjacent surface planes having respective inward ends that meet to form an intersection with an inward angle defining an apex line, said process further comprising the steps of:

(a) mounting a metallic flashing along the intersection of the planes, extending on both sides of the apex line over such a distance sufficient for preventing rainwater from reaching the roof surface;

(b) mounting said generally rectangular plates over said metallic flashing on both sides of the apex line, said plates having a longitudinal axis and having two long sides and two short sides, wherein said longitudinal axis is perpendicular to said apex line and wherein the short side being closest to said apex line is parallel to said apex line;

(c) mounting said moulding to said metallic flashing wherein said wide portion is placed under said plates and said recessed end receives the short edge closest to the apex line of said plates mounted over the flashing;

(d) cutting said shingles along a line determined by said moulding recessed end, mounting said cut shingles unto the plates with their cut edge being fitted within the upwardly curved recess of said moulding.

14. A process for covering a roof surface according to claim 12, wherein said roof surface further includes two adjacent surface planes having respective uppermost ends that meet to form an outward angle, said process further comprising the steps of:

(a) upwardly bending the shingles at said uppermost ends, such that said uppermost end shingles of said two surface planes form two substantially parallel adjacent bent portions about said outward angle;

(b) placing a tube member between said adjacent bent portions, said tube member being snugly fitted therebetween and having opposite sides, each said opposite sides being connected to a respective said bent portion to from a tube-shingle assembly; and (e) capping said tube-shingle assembly with a cap moulding.

15. A roof covering for mounting to a roof, said roof having a roof surface defining a peripheral edge, said roof covering comprising:

interconnected shingles, each said shingle comprising a substantially flat and generally rectangular shaped panel made of metallic sheet material, said panel having a top side and an under side and defining side edges, said top side displaying along at least two of said side edges a series of dimples defining corresponding bosses on said underside, a series of connecting elements having one end mounted to a corresponding boss and an opposite end projecting beyond said side edges, said connecting elements allowing connection with said roof surface, and locating means on said top and under sides for positioning said shingle with a corresponding similarly constructed shingle to define an overlapping region therebetween.

16. A roof covering according to claim 15 wherein each said connecting element consists of a tab member, said one end of said connecting element being pivotally riveted to said corresponding boss and said other end of said connecting element displaying an aperture for receiving a fastening element for connection to said roof surface.

17. A roof covering according to claim 15 wherein said interconnected shingles are staggered along the roof in regular arrays with their respective under sides substantially parallel to one another in said overlapping region.

18. A roof covering according to claim 17 wherein said regular arrays consist of at least four rows of overlapping shingles and wherein said over sides and under sides of overlapping shingles are maintained in close contact in said overlapping region for any particular shingle in a given row by the interconnection of said particular shingle with a shingle in a second lower row to said given row and by the interconnection of a shingle of a first upper row to said given row with a shingle in a first lower row to said given row, wherein said shingles of said first upper and first lower rows are adjacent to said particular shingle.

19. A roof covering according to claim 15, wherein the roof covering defines an outwardly projecting peripheral edge and wherein said bosses provide a space between said under side and said outwardly projecting roof peripheral edge, said roof covering further comprising plates for being fitted in said space and for being connected to both said shingles and said roof, and an open moulding mounted to said outwardly projecting roof covering peripheral edge providing ventilation of said roof covering.

20. A roof covering according to claim 15 wherein, said roof surface further includes two adjacent planes having respective inward ends that meet to form an intersection with an inward angle defining an apex line, said shingles of both planes being cut at said intersection along a line parallel to said apex line, said bosses providing a space between said under sides of the shingles and said roof surface, said plates being fitted in said space and being connected to both said shingles and said roof surface.

21. A roof covering according to claim 15 wherein said roof surface further includes two adjacent surface planes having respective uppermost ends that meet to form an outward angle, wherein the shingles at said uppermost ends of each of said planes have respective upwardly bent portions about said outward angle, said upwardly bent portions being adjacent and substantially parallel to one another, said roof covering further comprising tube members being fastened between said adjacent bent portions, and a cap moulding capping said upwardly bent portions.

22. A metal roofing shingle for mounting to a roof surface, said shingle having a substantially flat and generally rectangular configuration and comprising:

spacing means for upwardly and evenly spacing said shingle from said roof surface, said spacing means comprising a series of dimples defining corresponding bosses on the underside of said shingle;

connecting means for mounting said shingle to said roof surface, said connecting means having means so as to be adaptable to thermal expansion and contraction of said shingle; and locating means for positioning said shingle with a corresponding similarly constructed shingle, said locating means having means so as to be adaptable to thermal expansion and contraction of said shingle.

* * * * *